US005749216A

United States Patent [19]

Lang et al.

[11] Patent Number: 5,749,216

[45] Date of Patent: May 12, 1998

[54] OPEN END SPINNING APPARATUS

[75] Inventors: Kurt Lang, Lauterstein; Friedbert Schmid, Ueberkingen, both of Germany

[73] Assignee: Spindelfabrik Suessen, Schurr, Stahlecker & Grill GmbH, Suessen, Germany

[21] Appl. No.: 818,307

[22] Filed: Mar. 14, 1997

[51] Int. Cl.[6] ..... D01H 4/00

[52] U.S. Cl. ..... 57/413; 57/406; 57/408; 57/411

[58] Field of Search ..... 57/406, 407, 408, 57/411, 413, 414, 415, 417

[56] References Cited

U.S. PATENT DOCUMENTS

| | | | |
|---|---|---|---|
| 4,903,474 | 2/1990 | Stahlecker | 57/413 |
| 5,095,689 | 3/1992 | Ferro et al. | 57/263 |
| 5,109,663 | 5/1992 | Stahlecker et al. | 57/411 |
| 5,117,662 | 6/1992 | Stahlecker | 57/411 |
| 5,491,966 | 2/1996 | Billner | 57/413 |
| 5,581,991 | 12/1996 | Billner | 57/413 |

FOREIGN PATENT DOCUMENTS 37 04 460 8/1988 Germany .

WO 94/01605 1/1994 WIPO .

*Primary Examiner*—William Stryjewski

*Attorney, Agent, or Firm*—Evenson McKeown Edwards & Lenahan, PLLC

[57] ABSTRACT

In the case of an open-end spinning arrangement, a spinning rotor is arranged in a rotor housing, to which a vacuum of at least 500 mm water column is applied. A fibre feed channel, beginning at an opening roller with an entry opening, is directed with an outlet opening at a sliding wall of the spinning rotor. The fibre feed channel bends slightly in the direction towards a fibre collecting groove of the spinning rotor. The cross sectional area of the outlet opening of the fibre feed channel measures at least 19 $mm^2$ and amounts to at least 30% of the cross sectional area of the entry opening. As a result of the bend in the fibre feed channel, the fibres are collected together in a fibre bundle on a longitudinal side of the fibre feed channel. The fibre bundle occupies only a part area of the outlet opening when leaving the fibre feed channel and is fed with high precision onto the sliding wall. The outlet opening can thus have larger dimensions without this leading to inaccurate feeding of the fibres. The outlet opening possesses dimensions that permit a large volume of air to flow at high speed from the opening roller through the fibre feed channel. Fly accumulation in the area of the opening roller is thus avoided.

19 Claims, 3 Drawing Sheets

OPEN END SPINNING APPARATUS

BACKGROUND AND SUMMARY OF THE INVENTION

The present invention relates to an open-end spinning arrangement comprising a spinning rotor arranged in a rotor housing, to which a vacuum of at least 500 mm water column is applied, also comprising an opening roller arranged in an opening roller housing, and also comprising a tapering fibre feed channel for feeding fibres, which channel begins in the opening roller housing with an entry opening and ends in the rotor housing with an outlet opening, which has a cross sectional area measuring at least 19 $mm^2$ and which is directed onto a sliding wall of the spinning rotor, which sliding wall is disposed between a fibre collecting groove and an open edge of the spinning rotor.

Open-end spinning arrangements of the above mentioned type are used in spinning machines of the make "AUTO-CORO" which are made by the firm W. Schlafhorst AG & Co., 41004 Mönchengladbach, Germany. In the case of such open-end spinning arrangements, the fibres, which are released from the rotating opening roller under the action of centrifugal forces, are seized by a suction air flow and transported into the spinning rotor. The suction air flow also serves to support the fibres during release from the opening roller.

The suction air flow stems from the prevailing vacuum in the rotor housing, which vacuum is continued in the opening roller housing by means of the fibre feed channel, while the opening roller housing is connected to the atmosphere. The speed of the suction air flow increases in the direction towards the spinning rotor, in order that the fibres floating therein are accelerated and directed. The suction air flow must transport a minimum volume of air and have also in the area of the opening roller a minimum speed in order that the fibres are taken along in the desired way by the air stream and that fly accumulation in the area of the opening roller does not occur.

The vacuum is set at a certain level in the spinning machine, which level does not change during the spinning operation. For economic reasons, every effort is made to set the vacuum level at the lowest possible value.

The acceleration of the suction air flow between the beginning and the end of the fibre feed channel is obtained in that the outlet opening is constructed with a smaller cross sectional area than that of the entry opening.

The speed of the suction air flow and the volume of air contained therein at the entry opening is dependent on the cross sectional area of the outlet opening and the vacuum level.

In spinning practice, there is a demand to operate the spinning machines at ever increasing speeds. This is only possible when spinning rotors with smaller diameters are used. In the case of such spinning rotors, the diameters of the fibre collecting grooves, the open edges and the sliding walls tapering conically towards the open edge are all reduced in size. As an extension of a component comprising the outlet opening of the fibre feed channel projects through the open edge into the spinning rotor, the diameter of the open edge cannot just be reduced to any required size. Therefore, the axial length of the spinning rotor between the open edge and the fibre collecting groove, and thus the axial extent of the sliding wall, is reduced.

In the case of such a shortened sliding wall, it is necessary to feed the fibre stream with great precision thereon, so that fibres are not sucked off over the open edge nor land directly in the fibre collecting groove.

In order to limit the width of the fibre flow, the extent of the outlet opening was in the past reduced in axial direction of the spinning rotor. It was suggested (U.S. Pat. No. 4,903,474) that the outlet opening be widened in circumferential direction of the spinning rotor, in order to obtain a sufficiently large cross sectional area despite the reduction in width.

With this construction, the fibres exit over the entire cross sectional area of the outlet opening. The point at which the fibres arrive on the sliding wall is determined by the contour of the outlet opening and the direction of the last longitudinal section of the fibre feed channel. Due to the precise feeding of the fibres onto the sliding wall and the completely sufficient volume of air and air speed, this construction led in practice to excellent results. Due to the aforementioned air conditions, fly accumulation in the area of the opening roller was avoided.

It is suggested in U.S. Pat. No. 5,581,991 to construct in transport direction, in the last longitudinal section of the fibre feed channel, one wall as a fibre distributor surface, so that the fibres exit in the form of a type of fibre veil, which extends in circumferential direction of the sliding wall. For this purpose, the fibre distributor surface takes the form of a plane surface. Details of the air conditions prevailing in the fibre feed channel, for example the speed or volume of air, are not given.

In spinning practice, the requirement has now arisen to further reduce the risk of fly accumulation in the opening roller in the case of particular uses.

It is therefore an object of the present invention to increase the volume of air flowing through the fibre feed channel and to increase the air speed at the opening roller without increasing the vacuum level.

This object has been achieved in accordance with the present invention in that the fibre feed channel has a bend in the direction of the fibre collecting groove and that the cross sectional area of the outlet opening measures is least 30% of the cross sectional area of the entry opening.

By means of the bend in the direction of the fibre collecting groove, the fibres are deflected to only one of the longitudinal sides of the fibre feed channel. This longitudinal side faces the fibre collecting groove and is thus further away than the other longitudinal sides. Thus, from the point of the bend onwards, the fibres are no longer distributed over the entire cross sectional area of the fibre feed channel. The fibres are collected in a concentrated fibre stream on the aforementioned longitudinal side and take on the form of a fibre bundle. They exit in extension of the aforementioned longitudinal side as a fibre bundle through the outlet opening. They cover hereby only the part area of the outlet opening, which part area is in extension to the aforementioned longitudinal side, and not the entire cross sectional area of the outlet opening.

The point at which the fibres reach the sliding wall is dependent on the direction of the aforementioned, fibre bundle-guiding longitudinal side of the fibre feed channel. The point of contact is approximately there, where the extension of the aforementioned longitudinal side bisects the sliding wall. The point of contact has a significantly smaller surface dimension than the outlet opening. It is only approximately as big as the aforementioned part area of the outlet opening through which the fibre bundle exits. The direction of the longitudinal side of the fibre feed channel which guides the fibre bundle is so set that the point of contact is sufficiently far away from the fibre collecting groove while reaching as near to the open edge of the spinning rotor as possible without the fibres being lost thereover.

The point of contact is, as mentioned above, dependent essentially on the extent of the aforementioned longitudinal side which is furthest from the fibre collecting groove. The outlet opening can therefore be increased in the direction of the fibre collecting groove without this having an effect on the position or the area extent of the contact point. An increase in air throughput is thus obtained, without a dispersion of the fibres occuring, as would occur in the case of an enlargement of the cross sectional area in circumferential direction.

According to the present invention, the outlet opening is enlarged in such a way that its cross sectional area measures at least 30% of the cross sectional area of the entry opening. The volume of air flowing through the fibre feed channel is thus increased while the level of vacuum remains the same. In addition, the speed of the air flow is increased at the opening roller.

The bend can be such that the longitudinal side of the fibre feed channel which is nearer to the fibre collecting groove and the longitudinal side of the fibre feed channel furthest from the fibre collecting groove are both curved.

In an advantageous construction it is provided that the fibre feed channel extends linearly on the one side furthest from the fibre collecting groove, while the longitudinal side near the fibre collecting groove has the above mentioned bend. In the case of this embodiment, the fibres, already located on the linear side, maintain their transport direction. The other fibres reach the linear side at the bend and form a fibre bundle together with the there transported fibres.

In an advantageous embodiment of the present invention it is provided that the bend extends in longitudinal direction of the fibre feed channel in a slight curve. Due to the slight nature of the curve, the risk of fibre build-up is reduced, so that the fibres can form the desired fibre bundle without disruption. It would, of course, be possible to form the curvature as one or more sharp bends. The sharpness of the bend can be softened by means of a slight curve.

In a further advantageous embodiment, the fibre feed channel comprises on one of the longitudinal sides furthest from the fibre collecting groove a concavely curved surface. The formation of a fibre bundle is hereby further supported and the spreading out of the fibres in circumferential direction of the spinning rotor is reliably avoided.

In a further embodiment according to the present invention it is provided that the dimension of the outlet opening in axial direction of the spinning rotor is at least as large as its dimension in circumferential direction of the spinning rotor. This gives rise to an advantageous contour of the outlet opening which supports the transportation of the fibres to the contact point and aids a disturbance-free throughput of a large volume of air.

In an advantageous embodiment of the present invention it is provided that the outlet opening takes at least an approximate circular form. As a result of the even contours of the circular form, the fibres can be transported through the outlet opening to the contact point without hindrance.

In an advantageous embodiment of the present invention it is provided that despite smaller diameters of the spinning rotors of less than 30 mm, the outlet opening has a cross sectional area of more than 22 $mm^2$. The cross section of the outlet opening is significantly higher than in known embodiments, so that the transportation of a larger volume of air is possible.

In a further advantageous embodiment of the present invention, a cross sectional area of less than 85 $mm^2$ is provided for the entry opening. In this embodiment, a high speed of the air flow in the area of the opening roller is obtained, without the outlet opening becoming overly large.

In an advantageous embodiment of the present invention, the entry opening has at least approximately the form of a rectangle, which measures less than 20 mm in axial direction of the opening roller. The entry opening is here sufficiently large to transport fibres which are opened from a sliver of normal width into the fibre feed channel. This is based on fact that the width to which the fibres combed by the opening roller are spread out is proportional to the thickness of the sliver.

It is particularly advantageous in this embodiment of the present invention when the size of the entry opening in axial direction of the opening roller is less than 16 mm. This embodiment is particularly suitable for the production of fine yarns.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
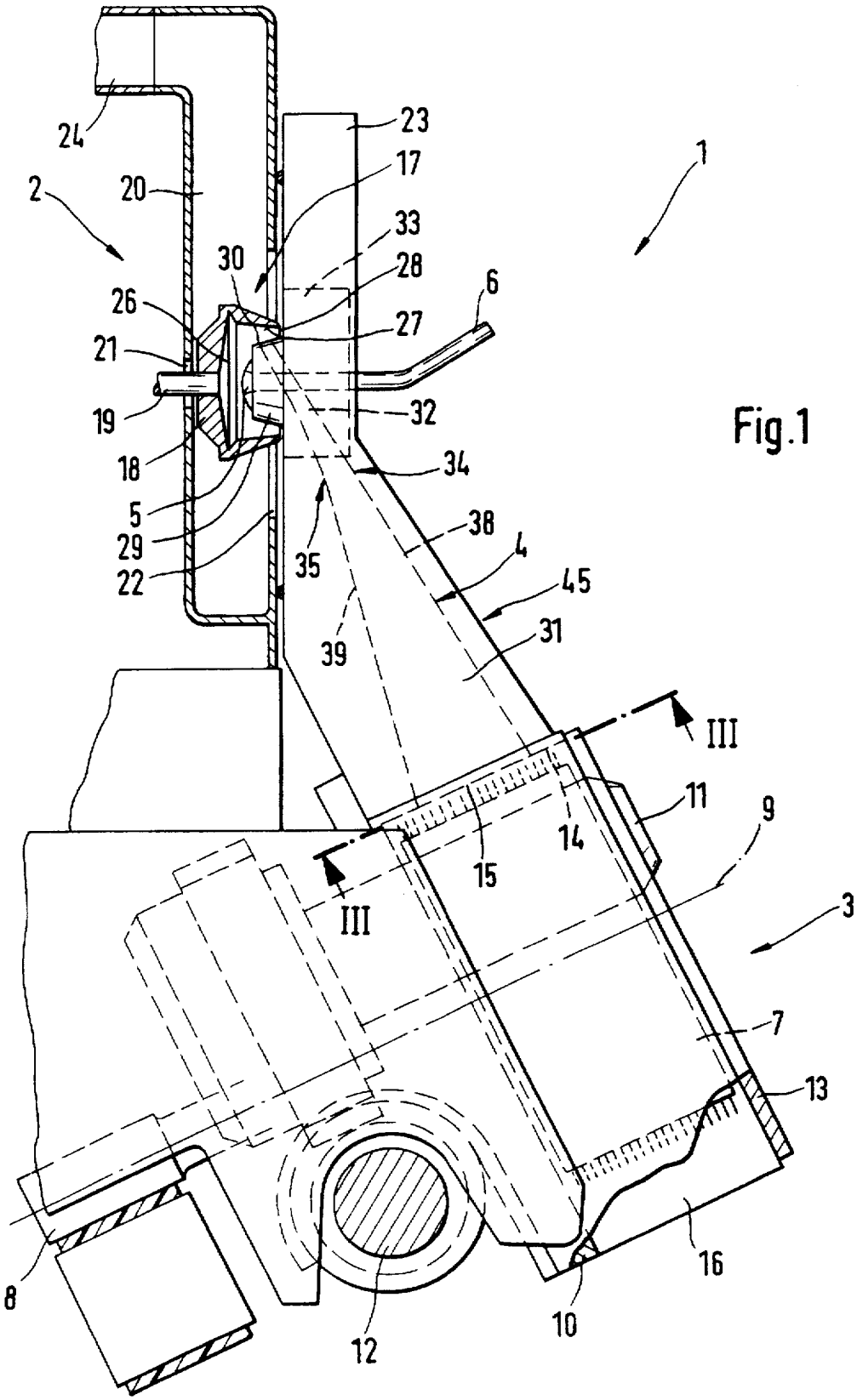
FIG. 1 is a section of an open-end spinning arrangement comprising a rotor unit, an opening unit and a connecting part comprising a fibre feed channel.
Figure 2:
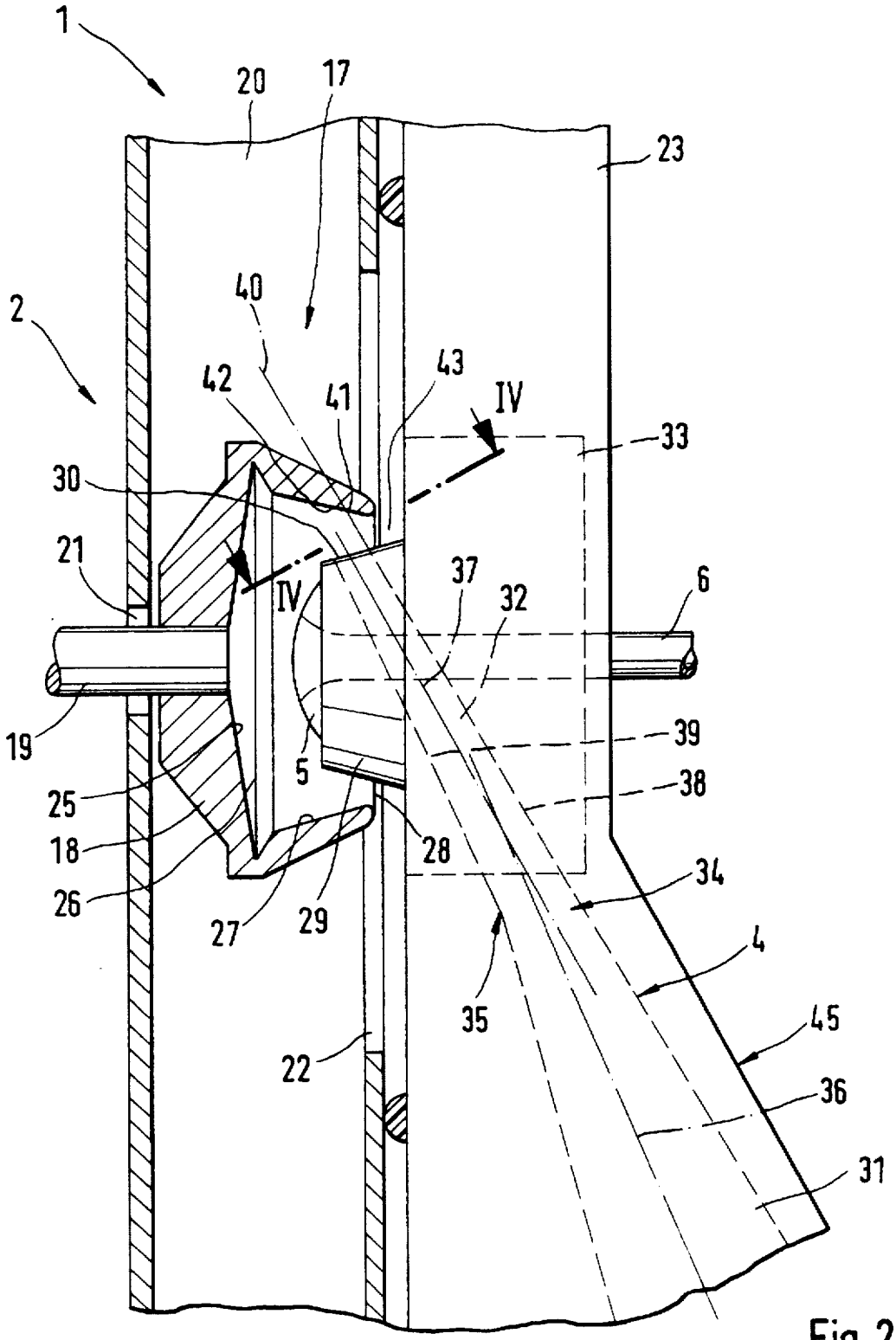
FIG. 2 is an enlarged partial view of the open-end spinning arrangement of FIG. 1.

The open-end spinning arrangement 1 shown in FIGS. 1 and 2 comprises a rotor unit 2, an opening unit 3 and a connecting piece 45 comprising a fibre feed channel 4, which connecting piece 45 connects the opening unit 3 with the rotor unit 2. During spinning, a sliver is fed to the open-end spinning arrangement 1, which sliver is opened to single fibres by the opening unit 3. The single fibres are fed through the fibre feed channel 4 to the rotor unit 2. There the fibres are spun to a yarn, which is withdrawn from the rotor unit 2 through a yarn withdrawal nozzle 5 and a yarn withdrawal channel 6 and wound onto a package (not shown).

The opening unit 3 comprises an opening roller 7, which is driven by means of a drive wharve 8 to rotate around an axis 9. The opening roller 7 is housed in an opening roller housing 10 and functions together with a sliver feed roller 11. The sliver feed roller 11 is driven by a worm roller 12 to rotate. The opening roller housing 10 can be swivelled around an axle coaxial to the worm roller 12 into a non-operational position.

The opening roller housing 10 is closed on its front side by means of a lid 13. The opening roller 7 is surrounded in circumferential direction by a peripheral wall 14 of the opening roller housing 10, which peripheral wall 14 comprises a plurality of openings, one of these openings forms an entry opening 15 to the fibre feed channel 4. A further opening, in rotational direction of the opening roller 7 upstream of the entry opening 15, connects the opening roller housing 10 with the atmosphere. This further opening serves as a ventilation opening 16 for the opening roller housing 10. The ventilation opening 16 can be constructed in such a way as to permit regulation of the volume of air. In another embodiment this opening can be used as an outlet opening for trash particles from the fibre material.

The rotor unit 2 comprises a spinning rotor 17, which comprises a rotor cup 18 and a shaft 19. The rotor cup 18 is housed in a rotor housing 20. The shaft 19 penetrates the back wall of the rotor housing 20 through an opening 21 and is supported and driven outside of the rotor housing 20 in a way not shown here. The rotor housing 20 is provided with a further opening 22 on its front side, through which the rotor cup 18 is accessible. The opening 22 is closed by a removable rotor housing lid 23, which is a component of the connecting piece 45.

The rotor housing lid 23 is connected in one piece with the opening roller housing 10 and can together therewith be swivelled around the axle coaxial to the worm roller 12. When the rotor housing lid 23 is swivelled, the spinning rotor 17 then becomes accessible.

The rotor housing 20 is connected by means of a vacuum supply line 24 to a vacuum source (not shown). The openings 21 and 22 are sealed in a suitable way so that no additional air can penetrate the rotor housing 20. During spinning, the effective vacuum in the rotor housing 20 is set at a value of between 500 and 800 mm water column.

The rotor cup 18 of the spinning rotor 17 has in a known way the form of a conical pot. As can be seen in particular in FIG. 2, the rotor cup 18, starting from an essentially plane rotor bottom 25, forms a fibre collecting groove 26 in the area of its widest inner diameter, which fibre collecting groove 26 is essentially V-shaped in cross section. A circumferential wall in the form of a sliding wall 27 adjoins the fibre collecting groove 26, which sliding wall 27 tapers conically in the direction towards the open edge 28 of the rotor cup 18.

The rotor housing lid 23 comprises a lightly conical projection 29, which projects through the open edge 28 into the inside of the rotor cup 18. The yarn withdrawal nozzle 5 is applied to the front end of this projection 29 and has its mouth almost on a level with the fibre collecting groove 26. The fibre feed channel 4 is guided in such a way that it leads into the circumferential side of this projection 29 with an outlet opening 30 opposite to the sliding wall 27 of the rotor cup 18.

As can be seen from FIG. 1, the fibre feed channel 4 comprises in longitudinal direction two sections 31, 32. The first section 31 is directly worked into the connecting piece 45. The second section 32 is housed in an extension piece 33, which is removably fixed to the connecting piece 45. The extension piece 33 comprises the projection 29 and in addition to the above mentioned second section 32 of the fibre feed channel 4 also the yarn withdrawal nozzle 5 and the first section of the yarn withdrawal channel 6. The extension piece 33 can, for example for spinning with a differently constructed spinning rotor, be easily replaced by another extension piece.

The fibre feed channel 4 which starts in the opening roller housing 10 tapers significantly towards the rotor housing 20. This tapering is not regular.

As can be seen from FIG. 2, one of the longitudinal sections 34 of the fibre feed channel 4 comprising the outlet opening 30 has a bend 35 in the direction towards the fibre collecting groove 26. This bend 35 is arranged at a distance from the outlet opening 30 and is disposed approximately in an area in which the first section 31 of the fibre feed channel 4 graduates into the second section 32 of the fibre feed channel 4. A bend 35 here is understood to be a directional change of the longitudinal axes 36, 37 of the feed channel 4 in the area of the bend 35. Important is here that the fibres are transported as a result of the bend 35, shortly before they exit out of the outlet opening 30, to that one of the longitudinal sides 38 of the fibre feed channel 4 which is furthest from the fibre collecting groove 26. In the embodiment of the present invention shown here, the bend 35 is located, as mentioned above, in an end area of the first section 31 and in an initial area of the second section 32 of the fibre feed channel 4. The bend 35 can take the form of a slight curve or a sharp bend.

In another embodiment of the present invention not shown, the fibre feed channel comprises three sections altogether. The rotor housing lid is not affixed to the opening roller housing, but rather can be separated therefrom by means of a swivel movement. The first section of the fibre feed channel is arranged in the opening roller housing. The second section is joined in one piece to the rotor housing lid. The third section is arranged in an extension piece, which is removably fixed to the rotor housing lid. When the rotor housing lid is raised from the rotor housing by means of a swivel action, the second section of the fibre feed channel which is arranged in the rotor housing lid slides along a sliding joint over the first section of the fibre feed channel housed in the opening roller housing. The fibre feed channel is thus divided into two parts when the spinning rotor is exposed. In this embodiment (not shown) the bend is located solely in the third section, beginning with the partition line to the second section of the fibre feed channel.

Alternatively, the bend could, of course, be continued in the second-last section.

As can be seen in particular in FIG. 2, the aforementioned longitudinal side 38, disposed furthest from the fibre collecting groove 26, extends in the embodiment described here, starting at the entry opening 15 (see also FIG. 1), in a linear fashion to the outlet opening 30. In the case of a longitudinal side 39, disposed opposite to the longitudinal side 38 and located nearer to the fibre collecting groove 26, its course runs differently. Starting from the entry opening 15, the longitudinal side 39 at first closely approaches the linearly extending longitudinal side 38. Thereafter, at a distance from the outlet opening 30, the longitudinal side 39 forms the aforementioned bend 35 in the direction towards the fibre collecting groove 26. Downstream of this bend 35, the longitudinal side 39 extends in the direction towards the outlet opening 30 in such a way that it only gradually nears the longitudinal side 38.

As can be gathered from the above description, the cross section of the fibre feed channel 4 decreases in size continuously in the direction towards the outlet opening 30.

It would also be possible in the case of an embodiment of the present invention not shown that the fibre feed channel 4 also comprises sections which do not taper. For example, a section with a constant cross section could be provided upstream of the outlet opening 30.

The fibre feed channel 4 is directed in the area of its outlet opening 30 at the sliding wall 27. It is hereby slightly inclined in the direction towards the fibre collecting groove 26. The extension 40 of the longitudinal side 38, shown by a dot-dash line, bisects the sliding wall 27 at the point 41. This point 41 lies at a short distance from the open edge 28 and at a larger distance from the fibre collecting groove 26 of the rotor cup 18.

During spinning, a suction air flow is generated by means of the vacuum prevailing in the rotor housing 20, which suction air flow is effective through the fibre feed channel 4 to the ventilation opening 16 in the opening roller housing 10 and in a weakened form as far as the sliver feed roller 11. The suction air flow streams along the circumference of the opening roller 7 and takes the single fibres, which as a result of the centrifugal forces have been released from the opening roller 7, along into the fibre feed channel 4. The speed of the suction air flow increases significantly inside the fibre feed channel 4 and reaches its highest value at the outlet opening 30. The floating fibres in the fibre feed channel 4 are hereby stretched and directed in longitudinal direction.

The single fibres, beginning with the entry opening 15 and going as far as the bend 35, are distributed essentially uniformly over the entire cross sectional area of the fibre feed channel 4. In the area of the bend 35, the fibres which have up to this point moved in proximity to the longitudinal side 39, now land, due to their inertia, in the area of the longitudinal side 38. They are collected there to a concentrated fibre stream and take on the form of a fibre bundle. This fibre bundle moves now in longitudinal direction of the longitudinal side 38 and exits out of the outlet opening 30. The fibre bundle occupies only a part area of the outlet opening 30, namely that part which is further away from the fibre collecting groove 26. It is mostly air that exits over that remaining part of the outlet opening 30 which is nearer to the fibre collecting groove 26.

In order that the fibres can be bundled on the longitudinal side 38 of the fibre feed channel 4, it is necessary that the imaginary extension of the longitudinal side 39 upstream of the bend 35 occurs inside the fibre feed channel 4, but still in close proximity to the outlet opening 30, on the longitudinal side 38.

The fibre bundle exiting in extension of the longitudinal side 38 lands on an initial contact point 42 on the sliding wall 27. This initial contact point 42 lies approximately in point 41, in which the extension 40 of the longitudinal side 38 intersects the sliding wall 27.

The initial contact point 42 has only a very small surface area, which lies clearly under the value of the entire cross sectional area of the outlet opening 30. Thus, fibres can be fed very precisely onto a desired point of the sliding wall 27, independent of the cross sectional area of the outlet opening 30. It is therefore possible to enlarge the outlet opening 30 in the direction towards the fibre collecting groove 26 without this having a negative effect on the exact feeding of the fibres.

The suction air flow which exits out of the outlet opening 30 with the fibre bundle gets into the vacuum conduct 24 from the inside of the rotor cup 18 through a ring gap 43 which is formed between the rotor housing 20, the rotor housing lid 23 and the open edge 28.

As already mentioned above, fly accumulation in the opening roller 7 can be extensively avoided when the suction air flow in the area of the opening roller 7 carries a sufficient volume of air and is sufficiently fast. Obtaining these favourable air ratios is dependent on the cross sectional area of the outlet opening 30, given an unchanged installed vacuum. It also depends on the ratio of the cross sectional area of the outlet opening 30 to the cross sectional area of the entry opening 15.

Figure 3:
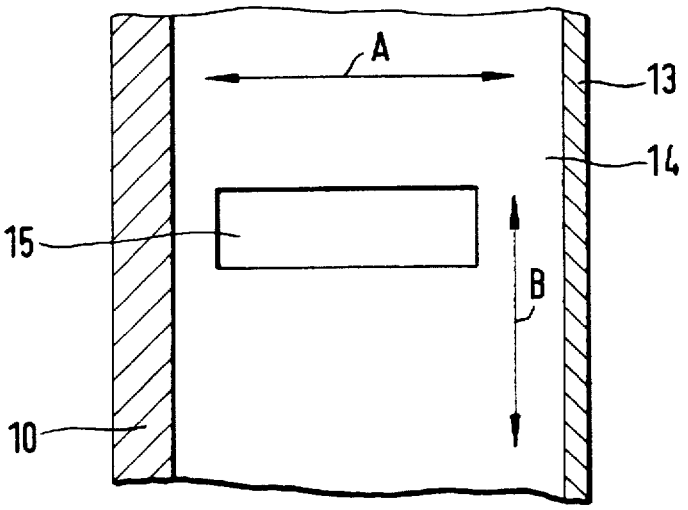
FIG. 3 is a cut view along the line III—III of FIG. 1 with an enlarged view of the entry opening of the fibre feed channel.

As can be seen from FIG. 3, the entry opening 15 takes the form of a rectangle. It is sufficiently large to permit the suction air flow along the opening roller 7 to be effective at least over that area width (in axial direction A) over which the fibres are guided. In the case of the embodiment according to the present invention described here, the open-end spinning arrangement 1 is applied for the production of less coarse yarns, that is, of yarns with a finer yarn count than Nm 16. Due to the relative thinness of the fed sliver, the single fibres do not spread out over the width (in axial direction A) of the opening roller 7 to the same extent as for example, a thick sliver would. In the case of the embodiment of the present invention shown here, the entry opening 15 measures in axial direction A of the opening roller 7 somewhat less than 16 mm.

In circumferential direction B of the opening roller 7, the entry opening 15 must be sufficiently large to permit the fibres floating in the opening roller housing 10 to reach the fibre feed channel 4. In the embodiment according to the present invention the entry opening 15 measures in circumferential direction B of the opening roller 7 somewhat less than 4.8 mm. This results thus in a cross sectional area of less than 77 $m^2$.

Figure 4:
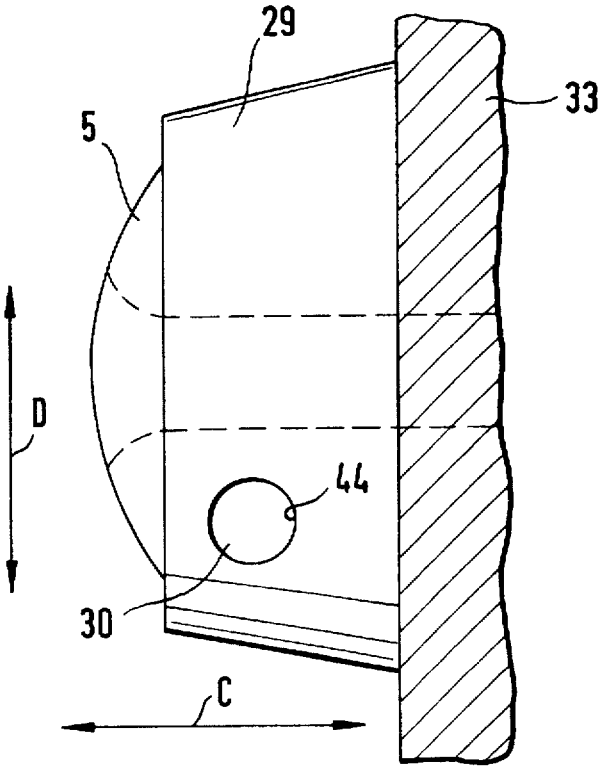
FIG. 4 is a cut view along the line IV—IV of FIG. 2 with an enlarged view of the area of the outlet opening of the fibre feed channel.

As can be seen from FIG. 4, the outlet opening 30 has a circular form. In this view, the front side of the projection 29 and the entry opening (front side) of the yarn withdrawal nozzle 5 should be visible, but for reasons of simplicity, these have been omitted.

As can be seen from FIG. 4, the outlet opening 30, due to its circular form, is at least as large in circumferential direction D of the spinning rotor 17 as in axial direction C of the spinning rotor 17. Adjoining the outlet opening 30, the longitudinal side 38, disposed furthest from the fibre collecting groove 26, forms a concavely curved surface 44. The formation of a fibre bundle is aided by the concave curve of the surface 44.

At a given installed vacuum, the air flow at the outlet opening 30 is set at a fixed speed, independent of the size of the outlet opening 30. The cross section of the outlet opening 30 determines however the volume of the air flow through the fibre feed channel 4, and also the volume of air at the opening roller 7. The size ratios of the cross sections of the outlet opening 30 and the entry opening 15 determine the air speed in the area of the entry opening 15. The bigger the outlet opening 30 is, the greater is the air speed and the air volume at the entry opening 15.

In order to obtain the desired air conditions, the cross sectional area of the outlet opening 30 is constructed large enough to permit the air speed and the air volume to be increased to favourable levels for spinning. According to the present invention, the diameter of the outlet opening 30 measures approximately 5.5 mm. Its cross sectional area measure thus somewhat less than 24 $mm^2$.

The ratio of the cross sectional area of the outlet opening 30 to the cross sectional area of the entry opening 15 lies thus in the embodiment according to the present invention at over 30%.

We claim:

1. An open-end spinning arrangement comprising a spinning rotor arranged in a rotor housing, to which a vacuum of at least 500 mm water column is applied, also comprising an opening roller arranged in an opening roller housing, and further comprising a tapering fibre feed channel for feeding fibres, which fibre feed channel starts with an entry opening in the opening roller housing and ends in the rotor housing with an outlet opening, which has a cross sectional area of at least 19 $mm^2$ and is directed onto a sliding wall of the spinning rotor, said sliding wall being disposed between a fibre collecting groove and an open edge of the spinning rotor, wherein the fibre feed channel has a bend in the direction of the fibre collecting groove and wherein the cross sectional area of the outlet opening amounts to at least 30% of the cross sectional area of the entry opening.

2. An open-end spinning arrangement according to claim 1, wherein the fibre feed channel comprises two longitudinal sides, one of them being further from the fibre collecting groove than the other one, wherein the longitudinal side which is furthest from the fibre collecting groove extends linearly and wherein the other longitudinal side has said bend.

3. An open-end spinning arrangement according to claim 2, wherein the longitudinal side disposed furthest from the fibre collecting groove has a concavely curved surface.

4. An open-end spinning arrangement according to claim 2, wherein the bend extends in a slight curve in longitudinal direction of the fibre feed channel.

5. An open-end spinning arrangement according to claim 4, wherein the longitudinal side disposed furthest from the fiber collecting groove has a concavely curved surface.

6. An open-end spinning arrangement according to claim 5, wherein the extent of the outlet opening in axial direction of the spinning rotor is at least as large as its extent in circumferential direction of the spinning rotor.

7. An open-end spinning arrangement according to claim 2, wherein the extent of the outlet opening in axial direction of the spinning rotor is at least as large as its extent in circumferential direction of the spinning rotor.

8. An open-end spinning arrangement according to claim 1, wherein the bend extends in a slight curve in longitudinal direction of the fibre feed channel.

9. An open-end spinning arrangement according to claim 1, wherein the extent of the outlet opening in axial direction of the spinning rotor is at least as large as its extent in circumferential direction of the spinning rotor.

10. An open-end spinning arrangement according to claim 9, wherein the outlet opening is at least approximately circular in form.

11. An open-end spinning arrangement according to claim 10, wherein the outlet opening (30) has a cross sectional area of more than 22 $mm^2$.

12. An open-end spinning arrangement according to claim 10, wherein the entry opening has a cross sectional area of less than 85 $mm^2$.

13. An open-end spinning arrangement according to claim 12, wherein the entry opening has at least approximately the form of a rectangle, which measures less than 20 $mm^2$ in axial direction of the opening roller.

14. An open-end spinning arrangement according to claim 13, wherein the entry opening measures less than 16 mm in axial direction of the opening roller.

15. An open-end spinning arrangement according to claim 1, wherein the outlet opening is at least approximately circular in form.

16. An open-end spinning arrangement according to claim 1, wherein the outlet opening has a cross sectional area of more than 22 $mm^2$.

17. An open-end spinning arrangement according to claim 1, wherein the entry opening has a cross sectional area of less than 85 $mm^2$.

18. An open-end spinning arrangement according to claim 1, wherein the entry opening has at least approximately the form of a rectangle, which measures less than 20 $mm^2$ in axial direction of the opening roller.

19. An open-end spinning arrangement according to claim 18, wherein the entry opening measures less than 16 mm in axial direction of the opening roller.

* * * * *